United States Patent [19]

Stout

[11] 4,417,858

[45] Nov. 29, 1983

[54] PLUNGER LIFT CONTROL

[75] Inventor: Gregg W. Stout, Montgomery, Tex.

[73] Assignee: Otis Engineering Corporation, Dallas, Tex.

[21] Appl. No.: 278,705

[22] Filed: Jun. 29, 1981

[51] Int. Cl.[3] ..... F04B 47/12

[52] U.S. Cl. ..... 417/58; 417/56

[58] Field of Search ..... 417/57, 56, 58

[56] References Cited

U.S. PATENT DOCUMENTS

| | | | |
|---|---|---|---|
| 2,649,738 | 8/1953 | Tait | 417/57 |
| 2,714,855 | 8/1955 | Brown | 417/57 |
| 2,918,015 | 12/1959 | Knox | 417/57 |
| 3,012,512 | 12/1961 | Shaw | 417/57 |
| 3,039,394 | 6/1962 | Brown et al. | 417/57 |
| 3,351,021 | 11/1967 | Moore, Jr. | 417/57 |
| 4,211,279 | 7/1980 | Isaacks | 417/58 |

*Primary Examiner*—William L. Freeh
*Assistant Examiner*—Paul F. Neils
*Attorney, Agent, or Firm*—H. Mathews Garland

[57] ABSTRACT

A well system includes a free lift plunger, and a gas supply line and associated motor valve for supplying intermittently injection gas to effect the lifting of the plunger and a slug of production liquid to the outflow line. The motor valve is diaphragm operated; and a control for this motor valve includes a known type of mechanical timer and associated valve which alternately pressurizes and vents its outlet line to alternately effect the closing and opening of the motor valve. An auxiliary control for this system includes a pilot valve and magnetic actuator which responds to the arrival of the lift plunger at the delivery point to effect the closing of the motor valve. A magnet, pivotally mounted on a lever, maintains the pilot valve closure member in a normal first condition, and is shifted by the arrival of the magnetic plunger to shift the valve closure member to a second condition to effect the closing of the motor valve.

5 Claims, 6 Drawing Figures

PLUNGER LIFT CONTROL

This invention relates to control of a plunger lift apparatus for producing oil and gas wells; and more particularly to magnetically actuated apparatus for valve shut-off, on arrival of the lift plunger.

The use of gas lift in producing an oil well is a well known means for fluid recovery; and one such means includes the use of a free plunger which may be lifted by the pressure of gas from the producing formation or, alternatively, may be lifted by gas which is injected into the well under the plunger. In either case, the plunger is caused to move cyclically within the tubing string to lift a slug of liquid from the oil bearing formation to a point of collection above the ground level, and then to return from that collection point to the starting point somewhere above the oil bearing formation.

In systems wherein gas is injected into the well from the well surface, the injection of such gas is effected intermittently and is preferably controlled automatically by a timing device which enables the selection of a first time period for injecting gas and effecting the lifting of the slug of liquid from the oil bearing formation to the surface, and a second time period when injection gas is shut off and which must be at least long enough to allow the plunger to return to the bottom of the well. The selection of the first time period will be based on the well history and performance; however, it is preferable to provide means for shutting off the injection of gas when the plunger reaches the top of the well, independently of the time selected by the timing mechanism. It is desirable, further, that an effective and reliable mechanism be provided for this purpose.

In gas lift systems wherein the pressure provided by the formation, and the gas phase of the oil-gas mixture is utilized to lift the slug of liquid, a timing mechanism is employed to control the opening and closing of a motor valve in the outlet flow pipe at the collection point; and this operation is again desirably performed automatically by a timing mechanism. Again, it is desirable to effect the closing of the motor valve in response to the arrival of the plunger, and independently of the timing mechanism, to minimize loss of gas pressure and enable a shorter lift cycle time.

Plunger pump gas-lift system of the type described can be used in low-pressure gas wells, in producing and unloading oils wells, for unloading fluids in high-pressure and high-volume gas wells, in gas wells on casing flow, and in paraffin cutting.

An object of this invention is to provide a control means for sensing magnetically the arrival of a lift plunger and effecting a suitable control of a valve.

Another object of this invention is to provide control means for sensing magnetically the arrival of a lift plunger and automatically shutting off the flow of lift gas.

A further object of this invention is to provide a control means for sensing magnetically the arrival of a lift plunger, and for acting in conjunction with a timer mechanism for controlling the operation of a valve.

These objects are accomplished broadly in control apparatus which includes a segment of non-magnetic pipe to be incorporated in a pipe string, and an actuator which includes a housing mounted on the exterior of that pipe segment. A magnet is supported within the housing for movement between two alternative positions relative to the pipe segment. A control valve mounted on the housing includes a valve closure member movable between two alternative positions. The valve closure member is coupled to the magnet.

More particularly the control apparatus includes a pneumatically operated motor valve, and a timing mechanism including a control valve for alternatively supplying a pressure fluid to the motor valve and venting the motor valve. Auxiliary control means for controlling the pressurizing and venting of the motor valve include the magnetic actuator and associated control valve.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
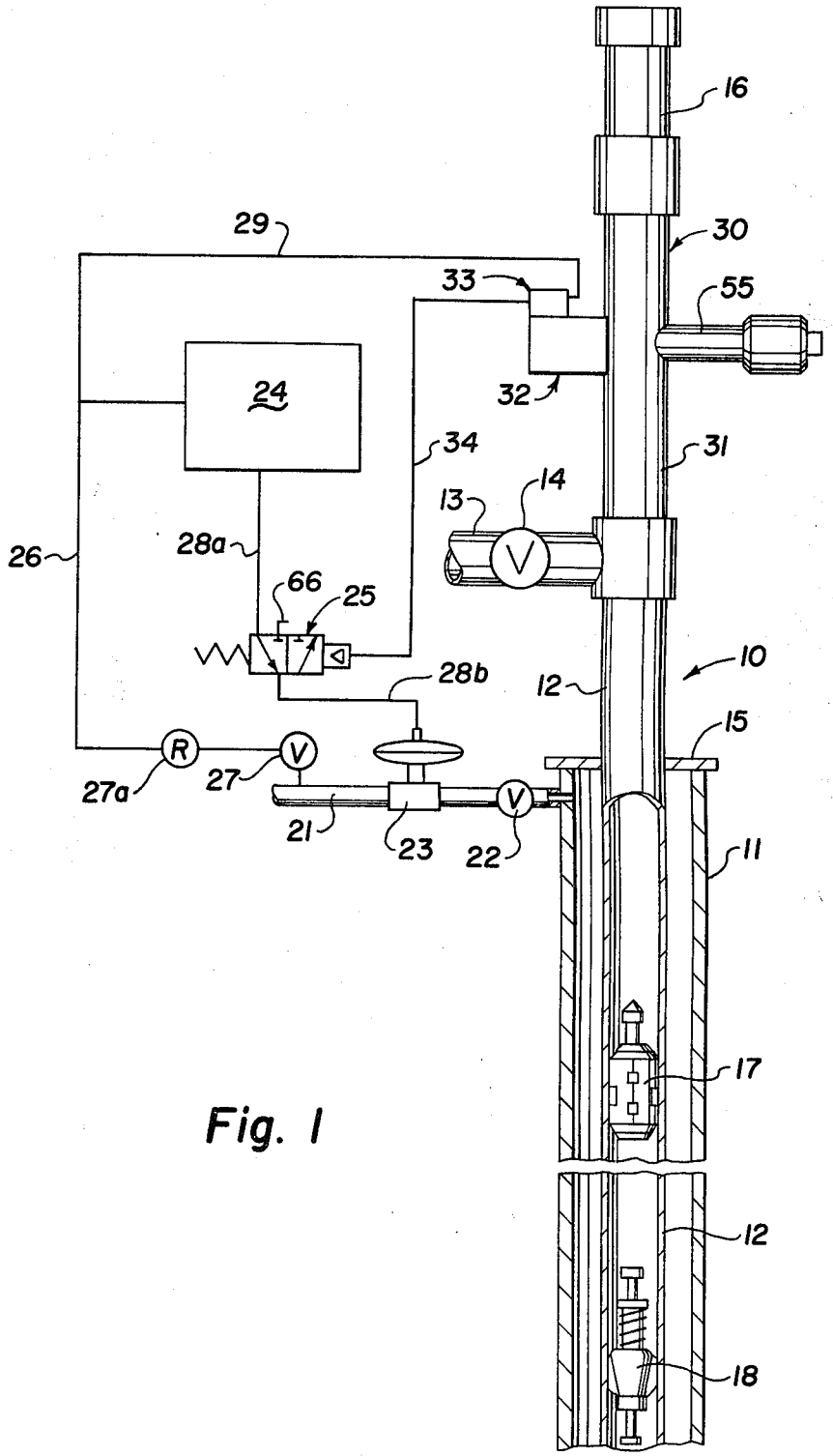
FIG. 1 is a diagrammatic illustration of an oil well system and associated control apparatus embodying the invention.
Figure 2:
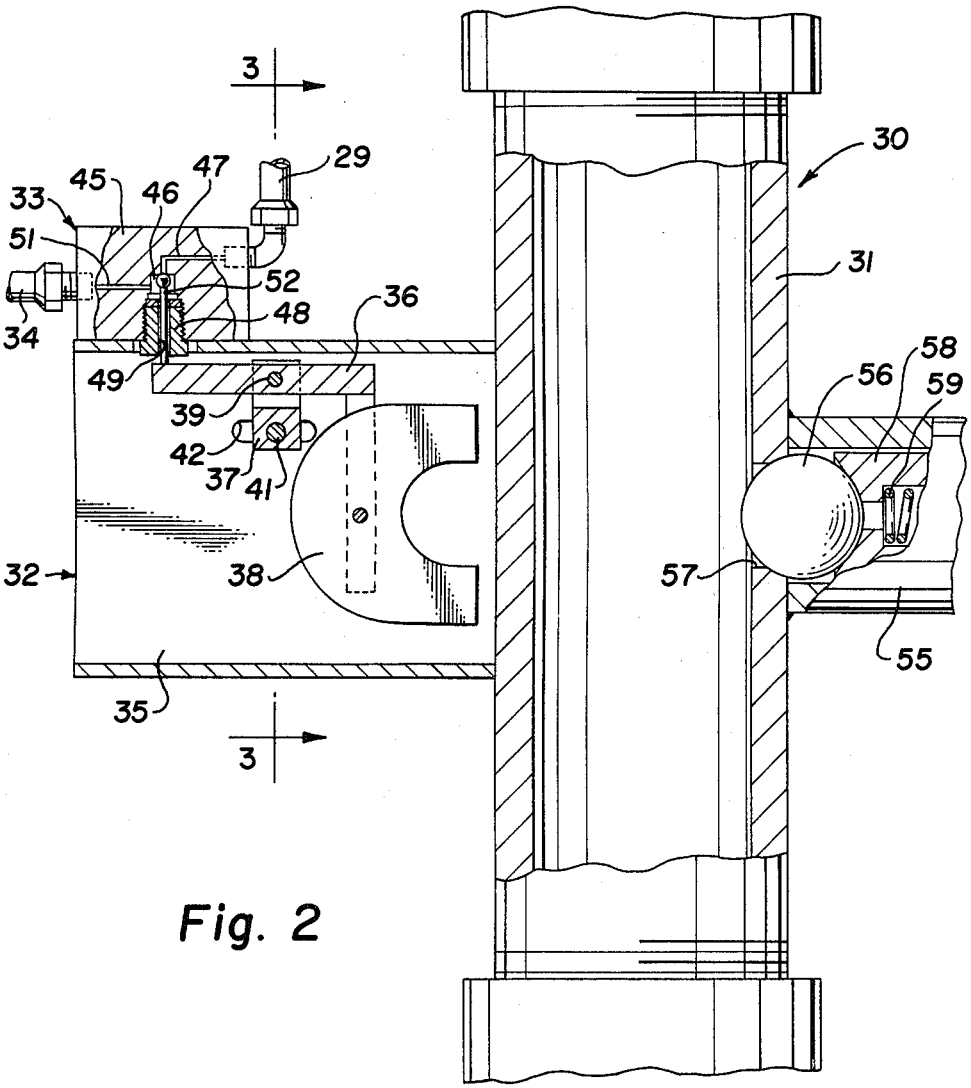
FIG. 2 is a sectional view of a magnetic valve actuator and associated control valve according to the invention.
Figure 3:
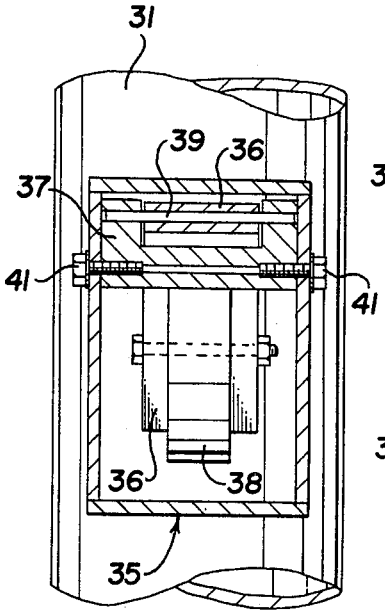
FIG. 3 is a sectional view taken along the line 3—3 of FIG. 2.
Figure 4:
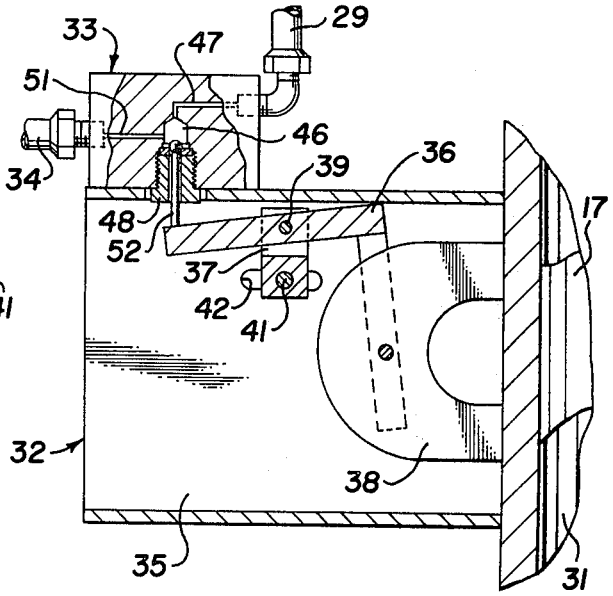
FIG. 4 is a fragmentary sectional view, corresponding to FIG. 2, illustrating a different condition of the valve actuator and associated control valve.

FIG. 1 is a diagrammatic illustration of a producing oil well system 10 including a gas lift plunger-pump, a system for injecting auxiliary lift gas into the well system, and a system for controlling the injection of the auxiliary lift gas including an actuator 30 according to the present invention. FIGS. 2, 3 and 4 illustrate details and operation of the actuator 30. The well system includes a casing 11 and a production tubing string 12 which extends above the casing at the surface and communicates with an out flow pipe 13, having an associated shut off valve 14 for collecting the production fluid. A cap 15 at the upper end of the casing closes the annular space between. the casing and tubing 12. The nipple of the actuator 30, to be described, defines a continuation of the tubing 12; and a lubricator-bumper sub 16 is mounted above the actuator nipple. This lubricator-bumper sub may include a shock absorbing bumper for a plunger moving into the sub.

A pneumatically driven plunger 17, of a construction known in the art, is disposed within the tubing for movement between a lower starting point intermediate the surface and the oil bearing formation and the collection point at the well surface. A bumper spring assembly 18 is placed within the tubing to define the starting point of plunger travel.

A system for applying auxiliary injection gas to the well includes an inlet pipe 21 connected to the casing 11 at the wellhead and including a manual shutoff valve 22. For automatic control of the flow of injection gas into the annulus between the casing and tubing, a diaphragm-operated motor valve 23 is placed in the gas supply line 21. In known gas lift systems, this motor valve is suitably controlled by a pneumatically operated mechanical timing mechanism and associated control valve. On a selected time cycle, such timing mechanism may, alternately, pressurize a signal line connected to the motor valve to open the valve, and vent that signal line to close the valve.

In the system according to the invention, the motor valve 23 is controlled by such a timing mechanism 24 with supplementary control by other components. The timing mechanism 24 is supplied operating gas through a gas line 26 coupled to the gas line 21, and an associated shutoff valve 27 and regulator 27*a*.

The well system 10 described above is a typical standard installation used in situations where either oil or water, or oil and water, are displaced from the well by gas including gas injected into the well through the annular space between the casing and tubing string. A plunger pump installation of the type illustrated is shown and described in Otis Engineering Corporation Catalog #OEC 5122 entitled "Gas Lift Equipment and Services," published in Nov., 1976. A similar plunger pump well installation is illustrated in U.S. Pat. No. 3,351,021, issued Nov. 7, 1967. A motor valve as referred to above is described and illustrated at Pages 36 and 37 of that Otis Engineering Corporation Catalog; and a timing mechanism as referred to above is described at Page 36 of that Otis Catalog. A plunger for use in such installations is also illustrated in that Otis Catalog.

The length of time for a complete single gas lift cycle depends upon a number of factors including: (1) the length of time required to pressurize the well to effect the lifting of the plunger and the overlying slug of liquid; (2) the length of time required to lift the slug of liquid to the outflow pipe; (3) the length of time required for the return of the plunger from the collection point to the starting point; and (4) the time required for the inflow of the desired quantity of production fluid into the tubing above the starting point. The elapsed time for one such cycle may be 20 minutes for example, or may be 1 hour for example. While the times for the various portions of that complete cycle may be reasonably constant, there will be some variation. When the timer mechanism 24 is employed to effect the closing of the motor valve 23 to shut off the flow of gas and allow the plunger to return to the starting point, the timer must be set to assure sufficient time for the pressurizing of the well with the injection gas and the complete delivery of the slug of liquid to the outflow pipe 13. If the timing mechanism effects the closing of the valve prematurely, some or all of the liquid is not discharged from the well and the injected gas employed to effect the lift is wasted, at least partially. On the other hand, if the time for these portions of the cycle are set with a large safety factor, there will be an excessive quantity of the injection gas discharged from the well through the outflow pipe 13. To obviate these disadvantages of complete control by the timing mechanism, an auxiliary control system is employed to close the motor valve 23 in response to the arrival of the plunger 17 at the collection point.

The auxiliary control, to be now described, includes the actuator 30 and an auxiliary control valve 25. The actuator 30 includes basically a non-magnetic nipple 31 which is an extension of the production tubing 12, a magnetic valve operator 32 mounted on the nipple 31, and a three-way pilot valve 33 mounted on the valve operator 32. The magnetic valve operator responds to the presence of the plunger 17 within the nipple 31, which plunger includes at least some parts fabricated from a magnetic material.

The auxiliary control valve 25 is a three-way valve interposed in the pressure signal delivery line 28*a*, 28*b* between the timing mechanism 24 and the operating chamber of the diaphragm motor valve 23. This auxiliary control valve, as illustrated diagrammatically in FIG. 1, is spring biased to a normal condition where it communicates the line segments 28*a* and 28*b* and allows flow of gas between the timing mechanism 24 and the motor valve 23. This valve is shiftable, under control of pilot gas, to a second condition wherein it plugs the line segment 28*a* from the timing mechanism 24 and vents the line segment 28*b* and the operating chamber of the motor valve 23. The pilot gas for shifting the auxiliary control valve 25, is controlled through the pilot valve 33 associated with the actuator 30. Pressurized gas is supplied to the pilot valve 33 through a supply line 29; and the pilot valve is connected to the pilot control chamber of the auxiliary valve 25 through a line 34.

The actuator 30 is illustrated in detail in FIGS. 2, 3, and 4, and includes a pipe nipple 31 of a size corresponding to the production tubing, and being fabricated from a non-magnetic material such as 304 non-magnetic steel. The magnetic valve operator 32 is an assembly including a rectangular housing 35 which is secured in any desired manner to the nipple 31 and which encloses and supports other components. These components include an L-shaped lever 36 having a generally horizontal arm and a downward projecting bifurcated arm. The horizontal arm is pivotally supported in a U-shaped support bracket 37; and a U-magnet 38 supported in the bifurcated arm with the legs of the magnet confronting the adjacent face of the nipple 31. The horizontal arm of the lever 36 is pivotally supported intermediate its ends by means of a horizontal pivot pin 39 in a manner that the weight of the magnet tends to rotate the lever to urge the distal end of the horizontal arm in an upward direction. This distal end of the arms controls the operation of the three-way pilot valve 33, mounted directly above, in a manner to be described. The support bracket 37 is confined between the side walls of the housing 35 and rigidly secured by clamping cap screws 41. These clamping cap screws pass through horizontally elongates slots 42 in the walls of the housing 35 to provide for horizontal positioning of the magnet 38 relative to the confronting wall of the nipple 31.

As best seen in FIGS. 2 and 4, the three-way pilot valve is mounted on the top of the operator housing 35, and includes a valve body 45 having an enlarged chamber 46 opening to the bottom face of the body 45 and which defines a valve chamber. An inlet passage 47 communicates with the upper end of the valve chamber and defines, with the chamber, an upper valve seat. The gas inlet 29 is coupled to this inlet passage 47 by means of a suitable nipple. The lower end of the chamber 46 is closed by a threaded plunger retainer 49 which is provided with an axial bore defining a bleed passage 49 which is also a passage for the stem of the valve plunger. The inner end of this plunger retainer 48 defines a lower valve seat associated with the bleed passage 49. An outlet passage 51 communicates with the valve chamber 46, intermediate the upper and lower valve seats, and the outlet line 34 is coupled to this outlet passage 51 by means of a suitable coupling. The valve closure member is a plunger 52 consisting of a closure head carried at the end of an elongated stem, the closure head being disposed within the valve chamber 46 and the stem extending through the bleed passage 49 and projecting below the valve body to be engaged by the horizontal arm of the lever 36.

FIG. 2 illustrates the normal condition of this pilot valve 33 wherein the valve plunger 52 is urged against the upper valve seat to close inlet passage 47. In this condition, the valve chamber 46 is vented to atmosphere through the bleed passage 49; and, accordingly, the line 34 is vented to atmosphere.

FIG. 4 illustrates the second condition of this pilot valve, effected by the movement of the magnet 38 toward the nipple 31, which movement is effected when the plunger 17 passes into the nipple. In this condition, the distal end of the horizontal arm of the lever 36 moves downward allowing the head of the valve plunger to seat on the lower valve seat closing the vent passage 49. This allows flow of gas from the inlet passage 47 to the outlet passage 51; and the pressure within the valve chamber 46 will maintain the valve plunger seated on the lower valve seat. In this condition, pilot gas is directed to the pilot chamber of the auxiliary control valve 25 to shift that valve and vent the operator chamber of the motor valve 23 thereby allowing that valve to close.

When the gas pressure under the plunger 17 is relieved, due to the closing of the motor valve and other factors, the plunger begins its return to the starting point. As soon as the plunger moves out of the nipple 31, the pilot valve 33 will return to its normal condition. The auxiliary control valve 25 is preferably of a design to remain shifted to the vent condition, until such time as the timing mechanism 24 shuts off the flow of gas to the auxiliary control valve through the line **28*a*** and vents that line.

Figure 5:
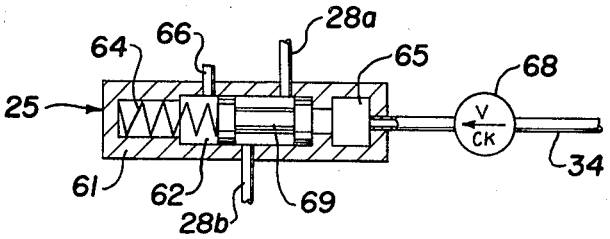
FIGS. 5 and 6 are additional diagrammatic illustrations of an auxiliary control valve illustrated in FIG. 1.
Figure 6:
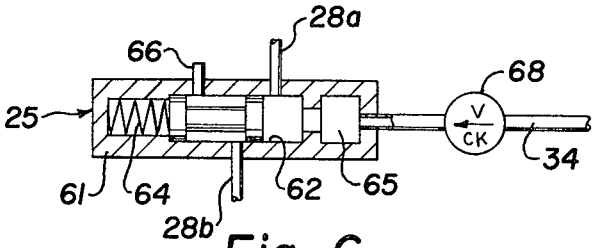

FIGS. 5 and 6 are diagrammatic illustrations of an auxiliary control valve 25, FIG. 5 illustrating the valve in the normal condition shifted by its biasing spring, and FIG. 6 illustrating the valve shifted to the second condition by the pilot gas. This control valve functions with the timing mechanism 24, to supply pressurized gas to the operator chamber of the motor valve through the lines **28*a* and 28*b*, and to vent that operator chamber until such time as a subsequent gas lift cycle is initiated. As illustrated in FIGS. 5 and 6, the auxiliary control valve includes a housing 61 providing a valve chamber 62, a chamber for an actuator spring 64, and a pilot chamber 65. The valve chamber is communicated with inlet line 28*a*, outlet line 28*b*, and a vent 66. The pilot chamber 65 is connected with the valve chamber 62 by means of a suitable passage. The line 34 is connected to the pilot chamber 65; and a check valve 68 may be provided in this line to prevent flow of gas from the pilot chamber into the line 34. A shiftable valve spool 69 controls the flow of gas through the valve 25**.

In the normal condition illustrated in FIG. 5, the spool is shifted by the spring 64 to provide communication between the inlet line **28*a* and the outlet line 28*b*, thereby allowing the motor valve 23 to be opened under control of the timing mechanism 24**.

FIG. 6 illustrates the second position, effected when the plunger 17 has passed into the actuator nipple 31, thereby effecting the flow of pilot gas through the line 34 into the pilot chamber 65 to shift the spool valve. In this condition, the operator chamber of the motor valve 23 is vented through the line **28*b* and the vent 66. It will also be seen that once the spool 69 is shifted, it is maintained in this shifted condition by the pressurized gas supplied through the timing mechanism and line 28*a*; and the check valve 68 prevents flow of gas back through the line 34. Hence, when the pilot valve 33 returns to its normal condition venting the line 34, this will not affect the condition of the auxiliary control valve 25. When the timing mechanism 24 shuts off the supply of gas to line 28*a* and vents this line, chamber 65 will be vented and the spool 69 will be shifted back to the normal condition by the spring 64; thus the control system is conditioned for the initiation of a succeeding gas lift cycle by the timing mechanism 24**.

While the operation of the well system and the apparatus of the invention is apparent from the foregoing, it will now be summarized briefly,. A gas lift cycle is initiated by the opening of the motor valve 23 to pass injection gas to the well to pressurize the well. Just prior to the beginning of this cycle, the motor valve is closed since its diaphragm chamber is vented through the valve 25 and timing mechanism 24. The plunger 17 is at its starting point, resting on the bumper spring 18, and in the case of a producing well, a quantity of production fluid has accumulated within the well tubing above the plunger. The pilot valve 33 and its magnetic operator 32 are in the position shown in FIG. 2, wherein the line 34 is vented.

The gas lift cycle is initiated by the timing mehanism 24 which opens a valve to direct gas through the line **28*a*, the control valve 25, and the line 28*b* to the operator chamber of the motor valve 23 to open that valve. Pressurized gas flows down the well through the annulus and enters the tubing 12 beneath the plunger; and when sufficient pressure has accumulated the plunger and the overlying slug of production fluid will be raised in the tubing string 12. The outflow pipe 13 is open so that when the slug reaches the collection point it will pass from the tubing through the outflow pipe. The lifting pressure will carry the plunger through the nipple 31 of the actuator 30 and into the lubricator-bumper sub 16 where snubbing action on the plunger may occur. The lifting gas pressure within the tubing will be dissipated through the outflow pipe 13**.

When the plunger 17 arrives at the nipple 31, the magnetic valve operator 32 will be shifted to the FIG. 4 position closing the line 34 vent, and passing pressurized gas through the line 34 to the pilot chamber 65 of the auxiliary control valve 25. The control valve 25 is shifted to the second condition to shut off the line **28*a*, which remains pressurized by the timing mechanism, and to vent the operator chamber of the motor valve through the line 28*b* and the control valve 25**. The motor valve then closes to shut off the supply of injection gas.

When the pressure in the tubing 12 has decreased sufficiently, the plunger 17 will begin its downward movement to the starting point. As soon as the plunger passes from the nipple 31, to pivot valve 33 will revert to its normal condition (illustrated in FIG. 2) to vent the line 34. Since the line **28*a* is still pressurized, the control valve 25 must remain in its vent condition to prevent re-pressurizing of the well at this point through the line 21. Accordingly, even after the line 34 is vented, the control valve 25 remains in its shifted condition under pressure of the gas from the line 28*a*; and when the line 28*a* is vented by the timing mechanism 24, the control valve 25 will be shifted to its normal condition by its actuator spring. When the plunger 17 again reaches the bumper spring 18**, the well system and apparatus are in condition for a succeeding gas lift cycle.

An actuator 30, as described, may typically include a catcher assembly for catching or latching the plunger 17 within the nipple 31 when that is desired. Portions of such a catcher assembly are illustrated in FIG. 2 including a housing 55, a ball 56 which may project partially through an aperture 57 in the wall of the nipple 31, a ball guide 58 and a spring 59 urging the ball guide and ball toward the aperture 57. This assembly would include, typically, an adjusting knob for adjusting the force of the spring 59 to either effect or inhibit the latching function.

What has been described is a simple, effective and reliable control apparatus which responds magnetically to the arrival of a lift plunger at the delivery point in a well system to close a major control valve. In the described system, that major control valve is a motor valve for injecting intermittently lift gas for the lift plunger. In another system, that major control valve might be a shut off valve in the outflow line 13.

While the preferred embodiment of the invention has been illustrated and described, it will be understood by those skilled in the art that changes and modifications may be resorted to without departing from the spirit and scope of the invention.

What is claimed is:

1. Control apparatus for use in a gas lift system for a producing well wherein liquid is lifted in the production tubing by a pneumatically driven magnetic plunger, said apparatus comprising a pneumatically operated motor valve in a flow line connected with said producing well;

a timing mechanism including a flow control valve connected between a supply line and a signal line connected to said motor valve for pressurizing and venting said motor valve for closing and opening said motor valve;

auxiliary control means for said motor valve including a magnetic actuator and associated pilot valve, said magnetic actuator comprising a segment of the production tubing fabricated from a non-magnetic material, a magnet supported on said tubing segment for movement between alternative first and second positions, a closure member for said pilot valve movable between alternate positions, and means for coupling said closure member and said magnet, said magnet being moved in response to detection of said pneumatically driven plunger to effect closing of said motor valve by operation of said pilot valve; and an auxiliary control valve in said signal line between said timing mechanism and said motor valve and connected with said pilot valve for pressurizing said motor valve to open said motor valve and for venting said motor valve to close said motor valve, said auxiliary control valve being biased toward a first operating position opening said signal line to open said motor valve, and said auxiliary control valve being moved to a second position by a pressure signal from said pilot valve upon detection of said plunger by said magnet closing said signal line to said motor valve and venting said motor valve to close said motor valve, and said auxiliary control valve being held at said second position by pressure in said signal line from said flow control valve in said timing mechanism for maintaining said motor valve closed until termination of said pressure signal from said flow control valve.

2. A control apparatus in accordance with claim 1 wherein said flow line connected with said well is an input line leading to an annulus in the well between the well casing and production tubing.

3. A control apparatus in accordance with claim 2 wherein said pilot valve is connected with said supply line and communicates said supply line with said auxiliary control valve to move said auxiliary control valve to said second position when said plunger is detected by said magnet and said pilot valve moves to a second position to shut off a pressure signal to said auxiliary control valve when said plunger drops away from said magnet.

4. Control apparatus in accordance with claim 1 wherein said pilot valve is connected with said supply line for supplying a pressure signal to said auxiliary control valve when said plunger is detected by said magnet to shift said auxiliary control valve to said second position for closing said motor valve and said pilot valve has a vent position for shutting off flow from said supply line to said auxiliary control valve and venting a line from said pilot valve to said auxiliary control valve when said plunger drops away from said magnet and said auxiliary control valve includes a vent port and a spool valve member, said spool valve member being spring biased to said first position closing off said vent port and communicating said signal line from said flow control valve in said timing mechanism to said motor valve for opening and holding said motor valve open and said spool valve is movable to said second position by a pressure signal from said pilot valve to communicate said motor valve with said vent port for closing said motor valve and a check valve between said auxiliary control valve and said pilot valve whereby pressure is maintained in said auxiliary control valve on said spool valve member holding said spool valve member at said second position by pressure in said signal line from said flow control valve of said timing mechanism to maintain said motor valve closed until said pressure signal from said timing mechanism is terminated.

5. A control apparatus in accordance with claim 4 wherein said flow line is an input line to an annulus in said well around said production tubing.

* * * * *